United States Patent [19]

Johnson et al.

[11] Patent Number: 4,586,837

[45] Date of Patent: May 6, 1986

[54] INK RIBBON CARTRIDGE INDICATION SYSTEM FOR PRINTER

[75] Inventors: Shepard D. Johnson, Charlotte, N.C.; Andrew French, Melbourne, Fla.; Allan E. Ellis, Spartanburg, S.C.; Dennis R. Hedrick, High Point; Charles D. Helfenberger, Concord, both of N.C.

[73] Assignee: International Business Machines Corp., Armonk, N.Y.

[21] Appl. No.: 644,469

[22] Filed: Aug. 27, 1984

[51] Int. Cl.[4] ..... B41J 35/14; B41J 35/18

[52] U.S. Cl. ..... 400/216.2; 400/290.4; 400/216.1

[58] Field of Search ..... 400/191, 207, 208, 211, 400/212, 215, 216, 216.1, 240, 240.3, 240.4, 703, 711, 213, 216.2, 216.3, 216.5, 217, 217.1, 227

[56] References Cited

U.S. PATENT DOCUMENTS

| | | | |
|---|---|---|---|
| 934,124 | 9/1909 | Yaw | 400/703 X |
| 1,009,351 | 11/1911 | Steele | 400/703 X |
| 4,236,839 | 12/1980 | Mueller | 400/216.1 |
| 4,280,767 | 7/1981 | Heath | 400/216.2 |
| 4,347,007 | 9/1982 | Schaefer | 400/208 |
| 4,401,394 | 9/1983 | Hume et al. | 400/208 |
| 4,407,595 | 10/1983 | Gershnow | 400/216.1 X |
| 4,425,046 | 1/1984 | Van Horne et al. | 400/212 X |
| 4,472,073 | 9/1984 | Valle et al. | 400/212 X |
| 4,494,886 | 1/1985 | Kondo et al. | 400/212 X |

FOREIGN PATENT DOCUMENTS

| | | | |
|---|---|---|---|
| 75878 | 5/1982 | Japan | 400/240 |
| 92586 | 6/1983 | Japan | 400/212 |
| 100207 | 5/1921 | Switzerland | 400/216.1 |

OTHER PUBLICATIONS

IBM Tech. Disc. Bulletin, "Flexible Platen Structure for a Dot Band Printer", Helinski et al., vol. 26, No. 2, Jul. 1983, pp. 596–597.

*IBM Technical Disclosure Bulletin*—Multicolor Matrix Impact Printer—vol. 21, No. 11, Apr. 1979, pp. 4448–4451, J. H. Meier.

*Primary Examiner*—Edgar S. Burr
*Assistant Examiner*—James R. McDaniel
*Attorney, Agent, or Firm*—Bell, Seltzer, Park & Gibson

[57] ABSTRACT

A printer includes a print mechanism defining a print region and a removable ink ribbon cartridge. The cartridge includes a body and two arms which are spaced apart and pivotally attached to the body with an ink ribbon across the gap between the ends of the arms in the print region. The printer includes an arm moving mechanism for moving the arms about their pivots on the body of the cartridge so that the portion of the ribbon in the print region can be moved laterally.

One of the arms is formed with a first indicator which cooperates with a sensing system on the printer to indicate the lateral position of the ribbon in the print region. The sensing system can also determine whether the cartridge is installed correctly in the printer. A second indicator is located on the arm and the sensing system can detect the position of this second indicator to indicate the type of ribbon in the cartridge.

5 Claims, 28 Drawing Figures

INK RIBBON CARTRIDGE INDICATION SYSTEM FOR PRINTER

FIELD OF THE INVENTION

The present invention relates to printers of the type which include ink ribbon cartridges which are removable from the printer for replacement or exchange of the ribbon and to systems for indicating certain characteristics of these ribbon cartridges.

BACKGROUND OF THE INVENTION

A printer includes a printing mechanism adapted to print characters or marks on a print medium such as paper located in the region of the printer adjacent to the print mechanism which is known as the print region. One known type of print mechanism includes at least one movable print element which is selectively moved towards the print medium in order to print marks on the print medium. Interposed between the print element and the print medium is a ribbon impregnated with ink and the ribbon is pressed into contact with the print medium by the print element in order that a mark in accordance with the shape of the print element may be printed on the print medium using the ink in the ribbon.

The ink ribbon is impregnated with ink of a desired color and composition and, as the printing operation continues, the ink is gradually transferred to the print medium. The ink ribbon is usually moved relative to the print mechanism so that different portions of the ribbon are used as the printing operation continues and the printer includes a ribbon feed mechanism to perform this ink ribbon movement. Eventually the ink in the ribbon becomes exhausted and the material of the ribbon becomes worn out and it is then necessary to replace the ribbon.

The ribbon, since it contains ink, is dirty for the operator to handle and therefore it is convenient to store the ribbon in a cartridge which can be inserted into and removed from the printer without the operator getting dirty hands. The cartridge will be connected to the ribbon feed mechanism so that the ribbon can be fed out of the cartridge, through the print region of the printer and back into the cartridge. The ribbon can be in the form of a continuous loop.

Since ribbons of different types can be used in the printer it is desirable to have some form of indication on the cartridge or on the ribbon itself of the type of the ribbon. If such an indication is visible it can be interpreted by the operator who can ensure that the correct ribbon is inserted into the printer. However with such an arrangement it may not be easy to see which type of ribbon is in a cartridge which is in the operating position in the printer. It is desirable for the printer itself to be able to detect which type of ribbon is in the operating position in order to be able to check whether instructions to print characters or marks in a certain color can be correctly interpreted by the printer.

In order to be able to print characters or marks in different colors without changing the ribbon in the printer it is known to use a ribbon which contains inks of different colors and compositions. For example the ribbon may be formed with a plurality of parallel stripes extending along the length of the ribbon, each stripe being separated from the adjacent stripes by some form of barrier and with a different ink composition being used to impregnate each of the stripes. In order to be able to place a stripe impregnated with a desired ink composition in the print region of the printer it will be necessary to be able to move the ribbon laterally of its length in addition to providing lengthwise movement by using the ribbon feed mechanism.

In order to provide this lateral movement it is known to support the cartridge about an axis extending parallel to the length of the portion of the multi colored ribbon in the print region and to pivot the ribbon cartridge about this axis. It is also known to feed the ribbon outside the cartridge along two arms which extend from the cartridge to opposite ends of the print region, in the direction of lengthwise movement of the ribbon, so that the portion of the ribbon between the arms extends through the print region. In order to provide lateral movement of the ribbon the arm can be pivotally attached to the frame of the printer and can be pivoted about the points of attachment. It is known to provide an indicator tab extending from an arm of this type which can be used to indicate the position of the arm.

It is also known to form a ribbon cartridge with an arm extending from and pivotally attached to the cartridge and to feed the ribbon from the cartridge along the arm to the print region of the printer and back into the cartridge. By pivoting the arm about its points of attachment to the cartridge the lateral position of the ribbon in the print region can be varied.

The object of the present invention is to provide a printer having a removable ink ribbon cartridge which can cooperate with a mechanism in the printer providing lateral movement of the portion of the ink ribbon in the print region of the printer and which has an indicator which cooperates with a sensing device in the printer so as to provide an indication of the transverse position of the portion of the ink ribbon in the print region, the type of ribbon in the cartridge and whether the cartridge has been correctly installed in the printer.

Another object of the invention is to provide a removable ink ribbon cartridge which can be used with a printer of this type.

SUMMARY OF THE INVENTION

A printer includes an ink ribbon cartridge which is removably mounted in the printer frame. The cartridge includes two spaced apart arms which define a gap and the ink ribbon extends from within the cartridge and across the gap between the arms. When the cartridge is located in the printer the portion of the ink ribbon extending across the gap is located in the print region of the printer. The printer includes a ribbon feed mechanism which cooperates with ribbon feed apparatus in the cartridge to feed the ribbon out of the body of the cartridge, through the print region and back into the body.

The arms are pivotally attached to the body of the cartridge and cooperate with a cartridge arm moving mechanism in the printer which selectively moves the arms so that the transverse position of the portion of the ink ribbon in the print region can be varied.

At least one of the arms is provided with an indicator which cooperates with a sensing device mounted on the frame of the printer and producing signals corresponding to the position of the indicator as the arms are moved. These signals are interpreted to indicate the transverse position of the ribbon in the print region.

The signals can also be interpreted to indicate whether the cartridge is correctly located on the frame of the printer and to indicate the type of ribbon in the cartridge.

An ink ribbon cartridge which can be used in a printer of the above type includes a body adapted to contain an ink ribbon and two arms each pivoted at one end to the body and spaced apart at their other ends so as to define a feed path for the ink ribbon outside the cartridge. The cartridge includes a ribbon feed apparatus for feeding an ink ribbon out of the cartridge, along one of the arms, across the gap between the ends of the arms and along the other arm back into the cartridge.

One of the arms is formed with a first indicator which is located at a predetermined position on the arm relative to the feed path.

The arm may also include a second indicator which is located at a predetermined distance away from the first indicator and the distance between the two indicators represents the type of ribbon in the cartridge.

BRIEF DESCRIPTION OF THE DRAWINGS

These and other objects, features and advantages of the invention will be more fully understood by those working in the art by reading and understanding the following description of a preferred embodiment of the invention, wherein reference is made to the accompanying drawings of which.

DETAILED DESCRIPTION OF THE INVENTION

Figure 1:
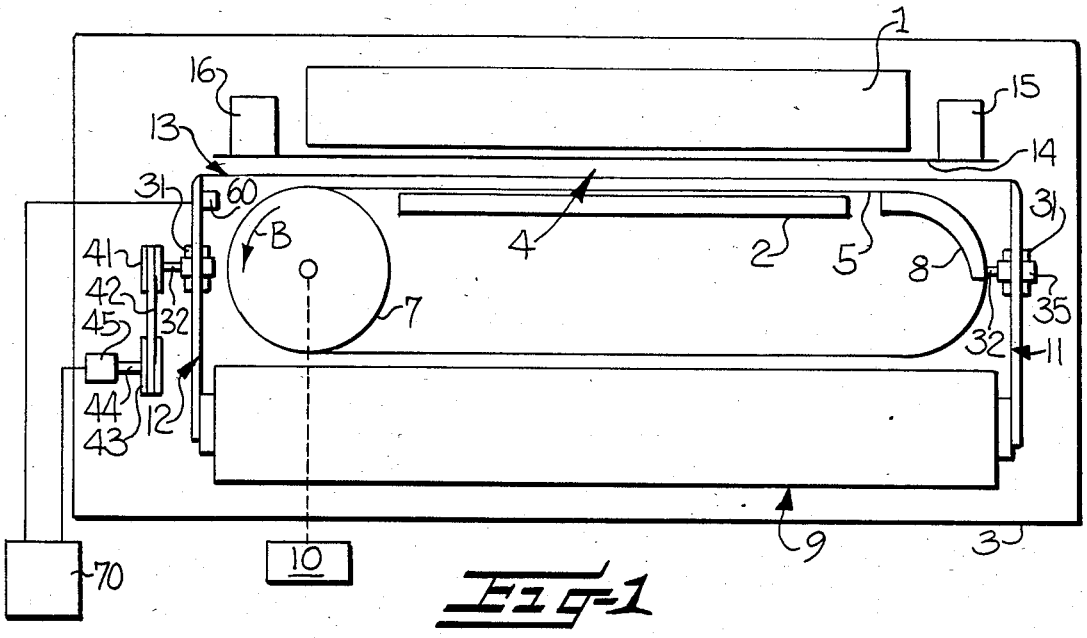
FIG. 1 is a plan view of a printer incorporating the invention.

With reference to FIG. 1 the printer includes a platen 1 and a hammer mechanism 2 mounted on the frame of the printer illustrated diagrammatically at 3, and defining between them a print region 4. A flexible metal band 5 in the form of a continuous loop and on which are mounted print elements 6 (see FIG. 2) is driven through the print region 4. The band 5 extends around a drive wheel 7 pivoted on the frame 3 and a guide member 8 fixed to the frame 3. An ink ribbon cartridge 9 formed with two arms 11,12 is removably mounted on the frame 3 and contains an ink ribbon 13 which extends across the space between the ends of the two arms 11,12. The arms 11,12 are positioned so that the ink ribbon 13 passes through the print region 4 between the band 5 and the platen 1. A print medium 14, for example a paper web, is driven through the print region 4 between the ink ribbon 13 and the platen 1 by a suitable drive mechanism illustrated diagrammatically at 15,16.

Figure 2:
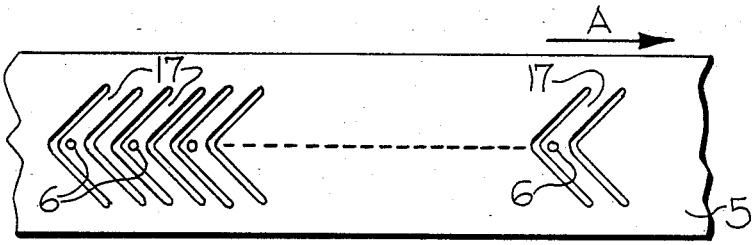
FIG. 2 is a side view of a print element band used in the printer of FIG. 1.

The continuous flexible metal print element band 5 is illustrated more clearly in FIG. 2 which is view of part of the band from the platen 1. The band 5 is formed with a plurality of print elements 6 which are dot elements. Each of the print elements 6 is attached to a flexible chevron shaped finger 17 and all the elements 6 are aligned along the length of the band 5. The band 5 is moved past the hammer mechanism 2 continuously in the direction of the arrow A in FIG. 2 by the rotation of the drive wheel 7 in the direction of the arrow B by a suitable drive mechanism illustrated diagrammatically at 10. The hammer mechanism 2 contains a plurality of hammers arranged in a bank extending along the platen 1 and operation of the hammer mechanism causes a selected hammer to strike against one of the print elements 6 and to press the element against the ink ribbon 13 which in turn is pressed against the print medium 14 resulting in the printing of a dot on a print line on the portion of the print medium 14 in the print region. Selective operation of the hammer mechanism and movement of the band 5 and the medium 14 cause the formation of characters on the medium by a matrix of dots in rows and columns. This type of printer operation is well known and is described by way of example in U.S. Pat. No. 4,428,284 and will not be described in greater detail here since it does not form an essential part of the invention.

Figure 3:
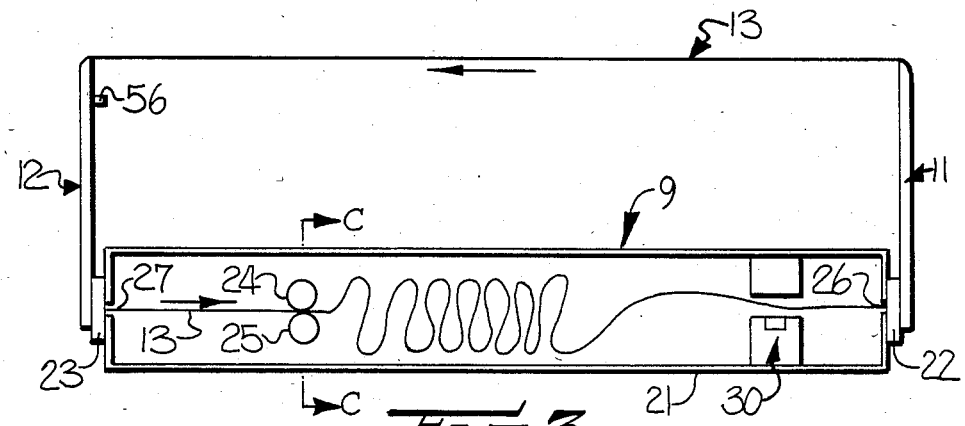
FIG. 3 is a plan view of an ink ribbon cartridge for the printer of FIG. 1.

The ink ribbon cartridge 9 is illustrated in greater detail in FIGS. 3, 4, 5 and 6. As seen in FIG. 3, the cartridge includes a hollow body 21 shown with its top cover removed and two arms 11,12 extending from opposite ends of the body. The arms 11,12 are pivoted at 22,23 respectively to the ends of the body 21. Within the body 21 are located a pair of feed wheels 24, 25 which are arranged to rotate in opposite directions by a suitable drive mechanism described below with reference to FIGS. 4 and 5. The ribbon 13 is in the form of a continuous loop and passes between the feed wheels 24,25.

When the cartridge 9 is in position in the printer a ribbon drive mechanism engages with and rotates the feed wheels 24,25. The continuous loop of ribbon is fed between the wheels 24,25 in the direction of the arrow and drawn out of the body 21 through an aperture 26 in the pivot 22, along the outer side of the arm 11, across the gap between the ends of the arms 11,12, along the outer side of the arm 12 and back into the body 21 through an aperture 27 in the pivot 23. The ribbon 13 is randomly stacked as illustrated in the body 21 between the feed wheels 24,25 and the pivot 22. By the action of the ribbon feed system described, the continuous loop of ribbon 13 is drawn continuously across the gap between the ends of the arms 11,12 through the print region 4 so that the portion of the ribbon 13 being used in the printing operation is continuously changed. A friction device 30 described below with reference to FIG. 6 ensures that the ribbon is tensioned as it passes through the print region and that only a single strand of ribbon emerges from the aperture 26.

Figure 4:
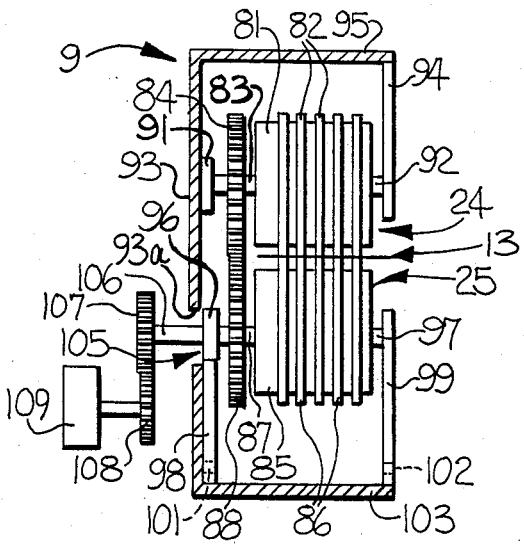
FIG. 4 is an end view of the body of the cartridge illustrated in FIG. 3 sectioned on the line C—C.
Figure 5:
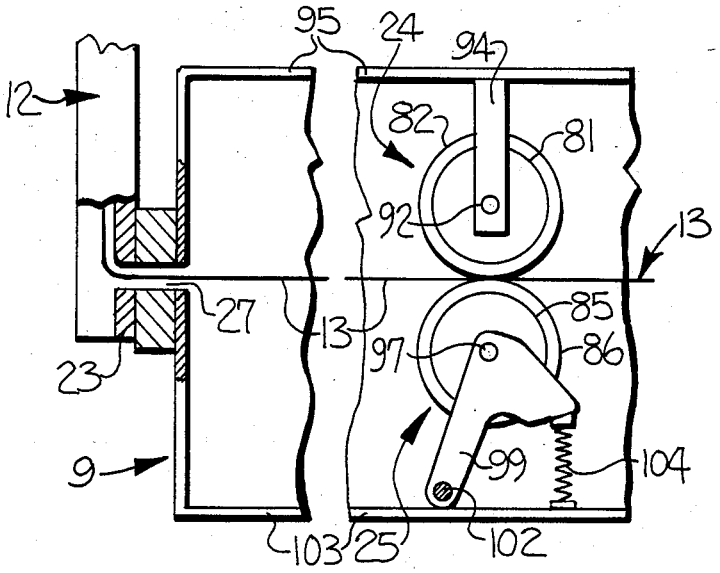
FIG. 5 is a plan view of the portion of the body of the cartridge illustrated in FIG. 4.

The ribbon feed mechanism is illustrated on a larger scale and in greater detail in FIGS. 4 and 5. FIG. 4 is an end view of the body 21 of the cartridge sectioned on the line C—C and FIG. 5 is a plan view of the end of the body 21 including the feed wheels 24 and 25 with the top cover of the body 21 removed.

Feed wheel 24 comprises a cylindrical body 81 formed with a plurality of circumferential bands 82 on its outer surface and mounted on a shaft 83 at one end of which is mounted a gear wheel 84. Feed wheel 25 comprises a similar cylindrical body 85 formed with a plurality of circumferential bands 86 on its outer surface and mounted on a shaft 87 at one end of which is mounted a gear wheel 88.

The shaft 83 is supported in two bearings 91 and 92 located respectively in the base 93 of the body 21 of the cartridge and in a fixed arm 94 extending inwardly from one side 95 of the body 21. The shaft 87 is supported in two bearings 96 and 97 located respectively in two pivoting arms 98 and 99 pivoted at 101 and 102 respectively from the other side 103 of the body 21. A spring 104 illustrated diagrammatically acts on the upper arm 99 to bias the arm towards the center of the body 21 of the cartridge.

The bearings for the feed wheels 24, 25 are located in the body 21 of the cartridge in such positions that the gear wheels 84, 88 mesh together and the outer surfaces of the circumferential bands 82, 86 are in contact. The spring 104 biases the feed wheel 25 towards the feed wheel 24 and ensures that the gears 84, 88 remain in mesh and that the bands 82, 86 remain in contact, but allow the feed wheel 25 to be moved temporarily away from the feed wheel 24 for insertion of the ribbon 13 as described below.

The circumferential bands 82, 86 are spaced apart axially on the respective bodies 81, 85 and provide surfaces for use in the feeding of the ink ribbon 13 which is arranged to pass between the feed wheels 24, 25.

Shaft 87 has a recess 105 formed in its lower end which is adapted to engage with the end of a drive shaft 106 on which is mounted a drive gear 107. The base 93 of the body 21 of the cartridge is formed with an aperture 93*a* to accommodate the drive shaft 106. The drive shaft 106 and the drive gear 107 are mounted on the frame of the printer and when the cartridge 9 is located in position on the frame of the printer the drive shaft 106 engages in the recess 105 in the end of the shaft 87. The recess 105 in the shaft 87 and the end of the drive shaft 106 are formed with cooperating surfaces so that rotation of the drive shaft 106 causes rotation of the shaft 87.

Drive gear 107 meshes with a gear 108 which is driven by a motor 109, illustrated diagrammatically, so that rotation of the motor 109 causes rotation of the shafts 106 and 87, and shaft 83 through the meshing of gears 84, 88.

The ink ribbon 13 is fed into the cartridge body 21 through the aperture 27 in the pivot 23 (see FIG. 5) and passes into the nip between the abutting circumferential bands 82, 86 of the feed wheels 24, 25. Rotation of the motor 109 causes rotation of the feed wheels 24, 25 in opposite directions so that the ribbon is fed in the direction of the arrow in FIG. 3. As illustrated in FIG. 3 the ribbon, on emergence from the nip between the feed wheels 24, 25, is arranged randomly in loops in the body of the cartridge. The ribbon feeding mechanism may include a suitable device such as fingers projecting from the sides of the body 21 between the adjacent circumferential bands on each of the feed wheels in order to strip the ribbon off the feed wheels.

In order to load the ribbon 13 into the cartridge, feed wheel 25 is pivoted against the bias of the spring 104 to form a gap between the feed wheels into which the ribbon is placed. Feed wheel 25 is then allowed to return towards its normal position abutting against feed wheel 24 and to clamp the ribbon 13 between the circumferential bands 82, 86 on the feed wheels 24, 25.

Figure 6:
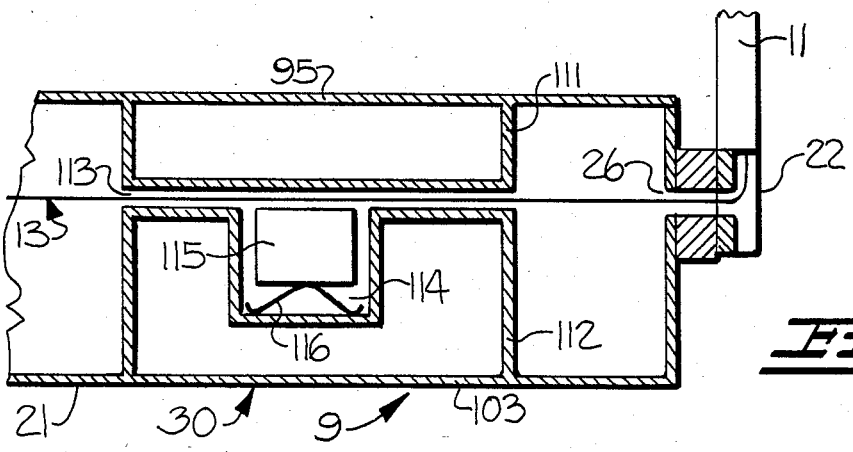
FIG. 6 is a plan view of the end of the body of the cartridge adjacent to the ribbon exit aperture.

The friction device 30 adjacent to the exit aperture 26 from the body of the cartridge is illustrated in greater detail in FIG. 6, which is a plan view of the friction device 30. The device 30 comprises a first generally rectangular box portion 111 which projects inwardly from the side 95 of the body 21 of the cartridge towards the center of the body 21 and a second generally rectangular box portion 112 which projects inwardly from the other side 103 of the body 21 towards the center of the body 21 so that a narrow channel 113 is defined between the adjacent inner surfaces of the rectangular box portions 111, 112. In the part of the box portion 112 adjacent to the channel 113 is formed a rectangular recess 114 and located in the this recess is a friction pad 115 and a spring 116. The spring 116 biases the friction pad 115 towards the channel 113 and as a result a dragging force is exerted on the ribbon as it passes along the channel 113.

The ink ribbon 13 is fed along the channel 113 and the friction pad 115 abuts against the ribbon and provides a frictional force which impedes the movement of the ribbon. This force ensures that the ribbon is in tension as it passes out of the body 21 of the cartridge along the arm 11, across the gap between the arms, along the arm 12 and back into the body 21 to be fed by the feed wheels 24, 25. The friction device 30, by constraining the ribbon to pass along the narrow channel 113, also ensures that only a single strand of ribbon passes through the channel and out of the body portion 21. This prevents any of the folds of the ribbon in the region of the cartridge between the feed wheels 24, 25 and the friction device 30 from jamming the exit from the body of the cartridge.

Figure 7:
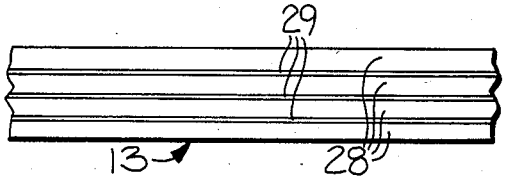
FIG. 7 is a side view of part of the ink ribbon used in the ribbon cartridge of FIGS. 3, 4, 5 and 6.
Figure 10:
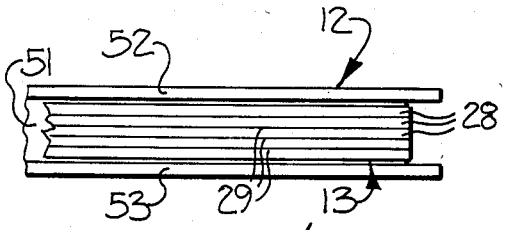
FIG. 10 is a detailed view of the end of the outer side of the cartridge arm illustrated in FIG. 3.

The ribbon 13 is a multicolored ribbon formed with four stripes 28 with different colored inks extending in parallel lines along the length of the ribbon and separated by barriers 29 to prevent ink from one stripe from passing into the adjacent stripes, as illustrated in FIG. 7. By using such a ribbon and selectively moving the ribbon transversely in the print region 4, as described below, printing can take place in different colors. For example the ribbon may have four stripes with magenta, yellow, cyan and black ink respectively enabling printing to take place in a total of seven colors by the well known subtractive process. Each of the stripes 28 and the barriers has a predetermined width.

Figure 8:
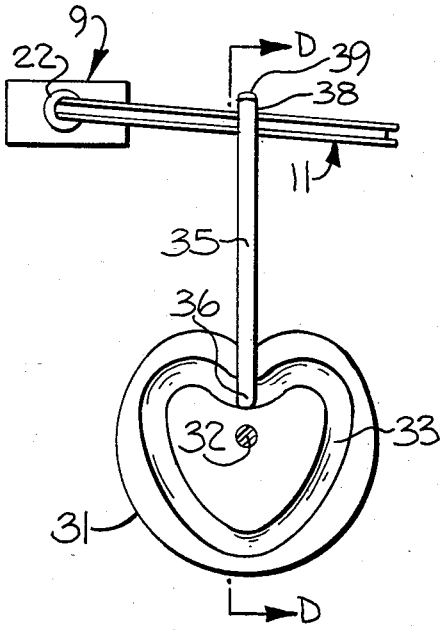
FIG. 8 is a side view of part of the mechanism for moving one of the arms of the ribbon cartridge illustrated in FIG. 3.
Figure 9:
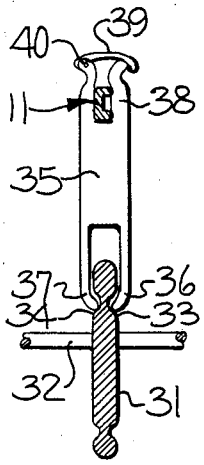
FIG. 9 is an end view of the mechanism illustrated in FIG. 8 sectioned on D—D.

The transverse movement of each arm 11,12 is controlled by a mechanism as illustrated in FIGS. 1,8 and 9. A cam wheel 31 is mounted on a shaft 32 and is formed with two grooves 33,34 on its opposite surfaces. A cam follower 35 is formed at its lower end with two inwardly extending projections 36,37 which engage in the grooves 33,34 respectively, and at its upper end with a U-shaped portion 38 which is adapted to clip around one of the arms 11 as illustrated. A closure member 39 is pivoted at 40 on one arm of the U-shaped portion 38 and is adapted to clip over the other arm in order to secure the arm 11 in the U-shaped portion 38. A cam wheel 31 and a cam follower 35 are provided for each of the arms 11,12. As illustrated in FIG. 1 the two cam wheels 31 are mounted on the same shaft 32 which at one end is provided with a pulley 41. The pulley 41 is coupled by means of a belt 42 to another pulley 43 mounted on a shaft 44 which is driven by a stepper motor 45.

By selective rotation of the stepper motor 45 the cam wheels 31 are rotated and the lower ends of the cam followers 35 are moved in accordance with the shapes of the two grooves 33,34 resulting in the cam followers 35 and the arms 11,12 being moved up and down about the pivot points 22,23. The grooves 33, 34 are shaped so that rotation of the shaft 32 and the cam wheel 31 by the stepper motor 45 results in a defined increment of transverse movement of the ribbon for a defined increment of stepper motor rotation. With the cam wheel 31 in the position illustrated in FIG. 8 the top edge of the uppermost stripe 28 of the ribbon 13 is on the print line in the print region 4. The projections 36, 37 are biased into the grooves 33, 34 by the natural resilience of the material of the cam follower and therefore engage tightly in the grooves thereby reducing the possibility of any backlash. By this arrangement the ribbon 13 can be moved transversely within the print region 4 and a selected one of the colored stripes 28 can be positioned correctly for printing on the print line in the print region.

FIGS. 10, 11, 12 and 13 illustrate on a larger scale and in greater detail the construction of the arm 12 and also illustrate the indicating device and sensing device which are used to determine the position of arm 12. Referring to FIGS. 10, 11, 12 and 13, arm 12 is formed with a central body portion 51 having a width approximately equal to the width of the ribbon 13 and two edge flanges 52,53 which extend at right angles to the body portion 51 and are wider than the thickness of the body portion 51 so that the combination of the body portion 51 with the flanges 52,53 forms a U-shaped guide for the ribbon 13 along the length of the arm. The ribbon 13 is illustrated in position in this guide. At the end of the arm 12 remote from the pivot 23 the flanges 52,53 extend beyond the end of the body portion 51 to form a further U-shaped guide extending around the end of the arm. The end of the body portion 51 is rounded so that the ribbon 13 is provided with a smooth path to turn through 90° in the U-shaped guide at the end of the arm in order that it can pass smoothly along the arm 12 and then across the gap between the ends of the arms 11,12. The extended portions of the flanges 52,53 prevent the ribbon falling off the end of the arm. It will be appreciated that arm 11 is formed in the same way as arm 12.

Figure 11:
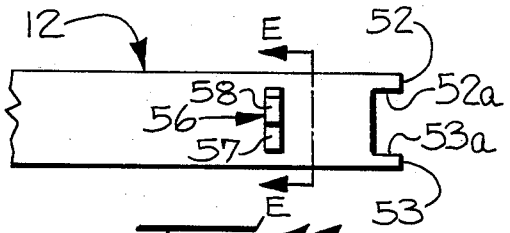
FIG. 11 is a detailed view of the end of the inner side of the cartridge arm illustrated in FIG. 3.
Figure 13:
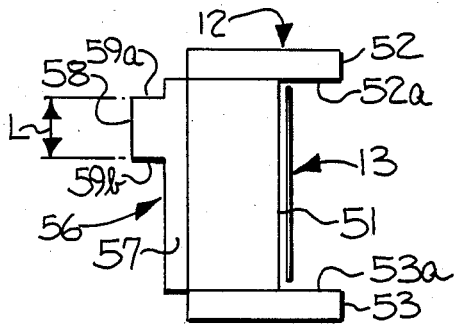
FIG. 13 is a detailed end view of an indicating device on the cartridge arm illustrated in FIG. 11 sectioned on the line E—E.

Adjacent to the end of arm 12 is attached an indicating device 56 which, as seen in FIGS. 11 and 13, is formed with a body portion 57 having a projecting tab 58 near its upper end. The length L of the tab 58 is variable and indicates the type of ribbon in the cartridge as will be described in greater detail below. The upper edge **59*a* of the tab 58 forms an indicator and is always in the same position on the body portion 57 regardless of the length of the tab 58. The lower edge 59*b* forms another indicator and the position of the lower edge 59*b* of the tab 58** indicates the type of ribbon in the cartridge.

The width of the ribbon 13 is exactly the same as the distance between the inner facing surfaces **52*a*, 53*a* of the flanges 52,53. Therefore, as the arm 12 moves up and down on its pivots, the ribbon 13 moves laterally in synchronism and the position of the upper edge 59*a* of the tab 58** accurately corresponds to the position of the ribbon.

Figure 12:
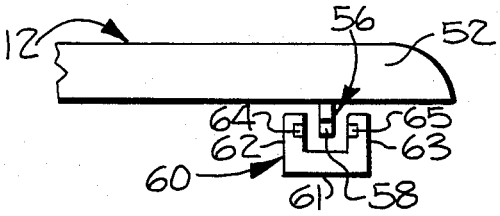
FIG. 12 is a detailed plan view of the end of the cartridge arm illustrated in FIG. 3.

The indicating device 56 is adapted to cooperate with a sensing device 60 which has a U-shaped body 61 with two arms 62,63 as illustrated in FIG. 12. In one arm 62 is mounted a source 64 of infra-red radiation and in the other arm 63 is mounted an infra-red radiation sensitive device 65. When the arm 12 is correctly positioned in the printer the tab 58 of the indicating device 56 is located between the arms 62,63, as illustrated in FIG. 12, and the tab 58 may intercept the radiation beam from the source 64 to the radiation sensitive device 65.

The arm 12 together with the indicating device 56 can be manufactured by molding a suitable plastic material using a mold with different inserts so as to be able to produce different length tabs 58.

Arm 11 is not illustrated as being provided with an indicating device 56. In an alternative arrangement arm 11 can be provided with another device 56 which will cooperate with another sensing device 60 in the same way as described above for arm 12.

The ribbon cartridge arm movement and position indication system described above is used to indicate the position of the ribbon in the print region and to control the transverse movement of the ribbon in the print region of the printer as follows.

When the ribbon cartridge 9 is inserted into the printer the body 21 is located over studs and clipped into position by any suitable device (not illustrated) so that the feed wheel shaft 87 engages with the drive shaft 106. The arms 11,12 of the cartridge will extend towards the print region 4 and the portion of the ribbon 13 extending across the gap between the ends of the arms 11,12 will be located in the print region. Each of the arms 11,12 should also be clipped into the respective one of the U-shaped portions 38 on the upper ends of the cam followers 35. However, if the operator is not careful, one or both of the arms may not be positioned correctly.

If the arm 12 is correctly positioned on its respective cam follower the indicating device 56 on arm 12 will be located between the arms 62,63 of the associated sensing device 60. Depending on its position, the tab 58 will or will not interrupt the radiation from the source 64 being received by the radiation sensitive device 65. It will be appreciated that, if the stepper motor 45 is rotated, the cam wheel 31 will be rotated and the arm 12 will move up and down thereby moving the tab 58 relative to the sensing device 60.

As part of the operation of installing a new ribbon cartridge and at other times during the operation of the printer, in order to indicate whether the cartridge has been installed correctly, to indicate the type of ribbon in the cartridge and to determine a reference condition for the stepper motor 45 which corresponds to the arm 12 and the ribbon 13 being in a Home position (see below), the stepper motor 45 is rotated so that the tab 58 moves relative to the sensing device 60 and the signal generated by the radiation sensitive device 65 is detected and analyzed as follows under the control of a programmed microprocessor 70 illustrated diagrammatically in FIG. 1 which is supplied with the output signals from the sensitive device 60 and provides drive signals to the stepper motor 45.

Figure 14A:
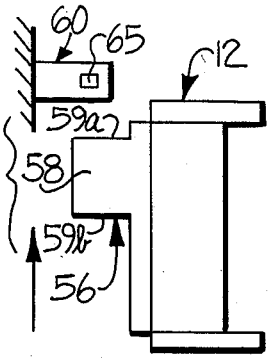
FIGS. 14*a*–14*i* are a series of views of the end of the cartridge arm illustrating the operation of the indicating device.
Figure 14B:
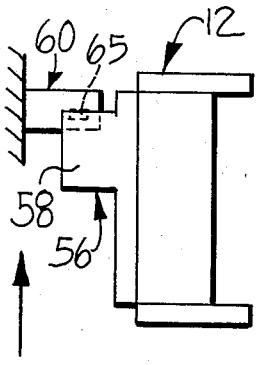
Figure 14C:
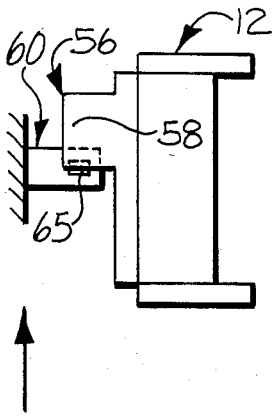
Figure 14D:
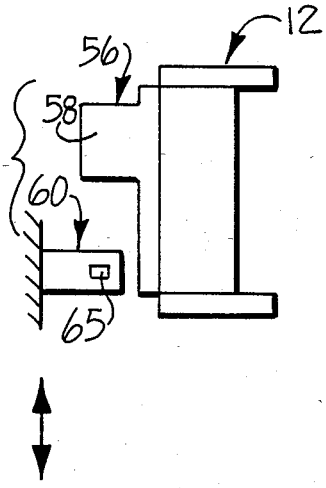
Figure 14E:
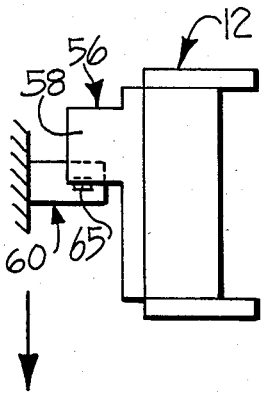
Figure 14F:
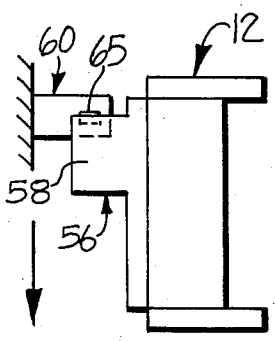
Figure 14G:
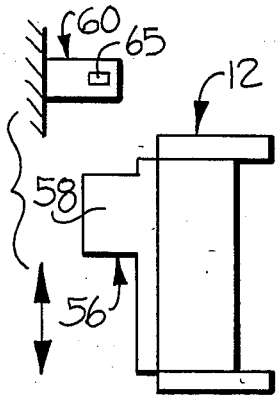
Figure 14H:
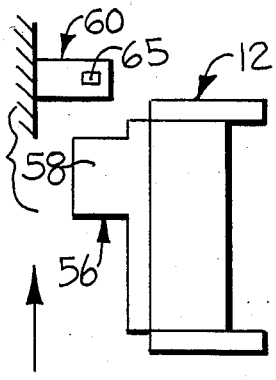
Figure 14I:
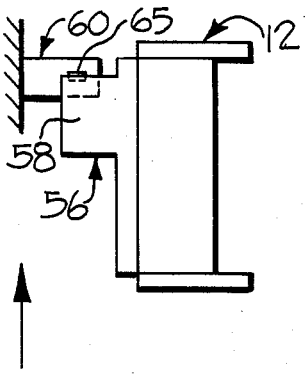
Figure 15:
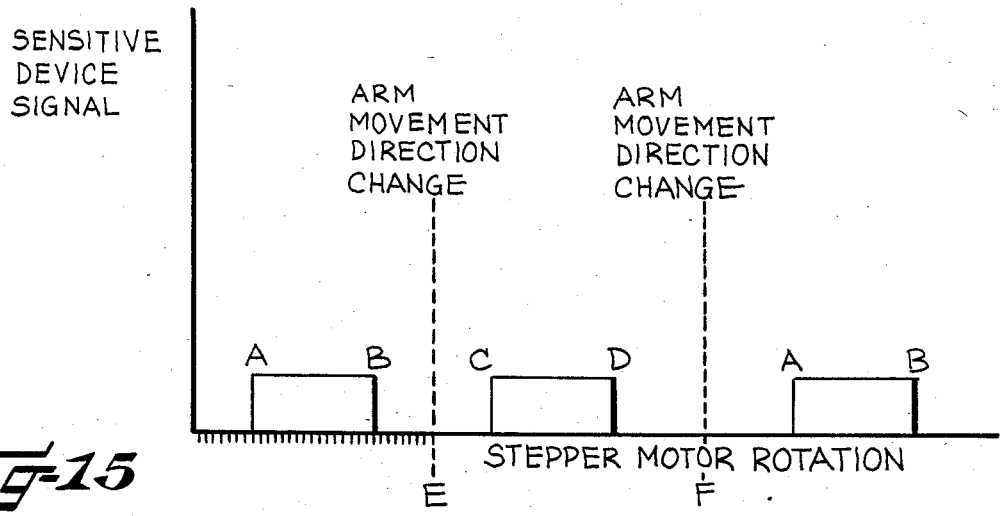
FIG. 15 is a graph illustrating the operation of the indicating device.

FIGS. 14*a*–14*i* represent this movement and illustrate various relative positions of the tab 58 and the sensing device 60 as the arm 12 moves, and FIG. 15 is a diagrammatic graph of the signal from the radiation sensitive device 65 corresponding to the receipt or non-receipt of radiation from the source 64 as the arm moves and the tab 58 either does or does not interrupt the beam of radiation. Device 65 is active and produces a signal of zero value when radiation is received and is inactive and produces a signal having a positive value when radiation is not received.

Referring to FIGS. 14*a*–14*i* in each Figure are illustrated the radiation sensitive device 65 of the sensing device 60 and the tab 58, with its upper edge 59*a* and its lower edge 59*b*, mounted on the arm 12. When the cartridge 9 is installed in the printer the arm 12 will be positioned in accordance with the rotational position of the cam 31 and this could be any position. By way of example it is assumed that, on installation of the cartridge, the arm 12 is located so that the tab 58 is below the sensing device 60 and the radiation sensitive device 65 is receiving radiation from the source 64. This condition is illustrated in FIG. 14*a* and the corresponding point on the graph of FIG. 15 is the join of the x-axis and the y-axis. The radiation sensitive device 65 receives radiation and produces a signal of zero value. Also by way of example the stepper motor 45 and the cam 31 are rotated in such a direction that the tab 58 starts to move upwardly as indicated by the arrow in FIG. 14*a*. It will be understood that this starting position and direction of rotation are chosen by way of example and in practice the tab 58 could be in another position relative to the sensing device 60 and the direction of rotation selected for the stepper motor could be different but the analysis operation described below will still be used.

As the stepper motor rotates and the arm 12 moves upwardly, eventually the upper edge 59*a* of the tab 58 will reach the radiation sensitive device 65 as illustrated in FIG. 14*b* and will interrupt the beam of radiation, resulting in a change of the signal generated by the device 65 to its positive value as indicated at A in FIG. 15. Further upward movement of the arm 12 will eventually result in the lower edge 59*b* of the tab 58 reaching the device 65 as illustrated in FIG. 14*c* and at this stage the tab 58 will stop interrupting the radiation resulting in a change of the signal generated by the device 65 to its zero value as indicated at B in FIG. 15.

With further rotation of the stepper motor 45, eventually the cam follower 35 will reach the position in the grooves 33, 34 which defines the topmost point of travel of the arm 12 as illustrated in FIG. 14*d* and at E in FIG. 15. At this point the signal from the device 65 remains zero but the direction of movement of the arm 12 changes from upward to downward as indicated by the double headed arrow in FIG. 14*d*. Continued rotation of stepper motor 45 will cause the arm 12 to move downwardly and eventually result in the lower edge 59*b* of the tab 58 reaching the device 65 as illustrated in FIG. 14*e* so as to interrupt the beam of radiation. This will cause the signal generated by the device 65 to change to its positive value as indicated at C in FIG. 15.

As the rotation of the stepper motor 45 continues still further, eventually the upper edge 59*a* of the tab 58 will reach the device 65, as illustrated in FIG. 14*f*, resulting in the interruption of the radiation beam ceasing causing the signal from the device 65 to change to its zero value, as indicated at D in FIG. 15. As the motor 45 continues to rotate the arm 12 will eventually reach its lowest position as illustrated in FIG. 14*g* at which position the direction of movement of the arm will change to upwardly. This position is indicated at F in FIG. 15 and the signal generated by the device 65 will remain at zero.

As the motor 45 still continues to rotate, eventually the arm 12 will reach the position illustrated in FIG. 14*h* which was its initial position at the start of the analysis operation (see FIG. 14*a*). The stepper motor 45 and the cam 31 will have completed a full revolution of 360°. Finally the stepper motor continues to rotate until the upper edge 59*a* of the tab 58 once again reaches the device 65 as illustrated in FIG. 14*i* and interrupts the beam of radiation. The signal from the device 65 will become a positive value again as illustrated at A in FIG. 15.

It will be appreciated that at this stage a complete cycle of the analysis operation will have been completed and any further rotation will merely repeat the earlier changes in the values of the signal from the device 65.

By analyzing the number of stepper motor steps which were needed to move from A to B, B to C, C to D and D to A as illustrated in FIG. 15 certain characteristics of the cartridge can be determined and the home position of the arm 12 can be determined.

The number of stepper motor steps corresponding to the distance from A to B (equal to the distance from C to D) represents the length L of the tab 58 and this variable parameter indicates the type of ribbon which is in the installed cartridge.

The number of stepper motor steps corresponding to the distances from B to C and from D to A are determined. Initially it will not be clear which one of these distances corresponds to the movement of the arm 12 through its lowest position. However since the edge 59*a* is at a predetermined fixed position on the tab 58 independent of the length of the tab, the number of stepper motor steps corresponding to the distance moved by the arm 12 from the position illustrated in FIG. 14*f* in which the upper edge 59*a* ceases to interrupt the beam, through the position illustrated in FIG. 14*g* in which the arm 12 is in its lowest (Home) position, and back up into the position illustrated in FIG. 14*i* in which the edge 59*a* once again interrupts the beam should be equal to a reference value. It will therefore be possible to recognize which of the distances B to C or D to A represents the movement of the arm through its lowest position. If the number of steps measured does not equal the reference value this will indicate that the arm 12 is not located correctly in the cam follower 38 or that the cartridge 9 is not correctly installed in the printer.

Further, half the number of stepper motor steps corresponding to the distance from D to A, assuming this distance has been determined to correspond with the movement of the arm 12 through its lowest (Home) position, will represent the position F, the lowest position of the arm and by adding this to the total number of stepper motor steps corresponding to movement of the arm 12 from its initial position (FIG. 14*a*) to the position in FIG. 14*f* the relation between the initial position of the arm and its lowest position can be calculated. This lowest position of the arm is called the Home position and once the rotational position of the stepper motor 45 which corresponds to this Home position has been determined it will be possible to calculate the rotational position of the stepper motor which will be required to position any selected portion of the ribbon in the print region of the printer.

From the above discussion of the analysis of FIG. 15 it will be appreciated that the analysis can be used to indicate the type of ink ribbon in the cartridge, whether the cartridge is correctly installed in the printer and the movement of the arm which is needed to locate any selected portion of the ink ribbon in the print region of the printer.

It is necessary to locate the ink ribbon transversely in the print region accurately so as to make use of the full width of each stripe on the ribbon. It is therefore necessary to determine the distance D to A corresponding to movement through the Home position very accurately. Due to the construction of the radiation source 64 and the radiation sensitive device 65 the width of the beam which is interrupted by the tab 58 is appreciable and if the beam is interrupted by movement of the edge 59*a* in two opposite directions the positions of the edge which will result in interruption of the beam will be different.

Figure 16A:
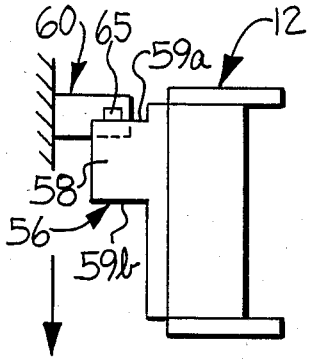
FIGS. 16*a*–16*e* are another series of views of the end of the cartridge arm illustrating another aspect of the operation of the indicating device.
Figure 16C:
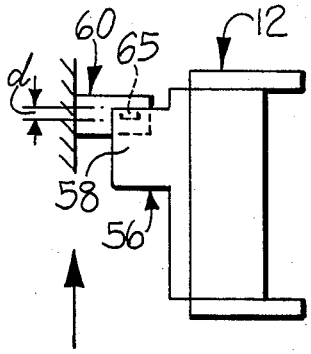
Figure 16E:
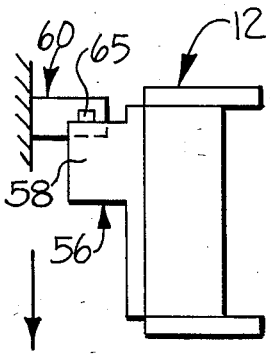
Figure 16B:
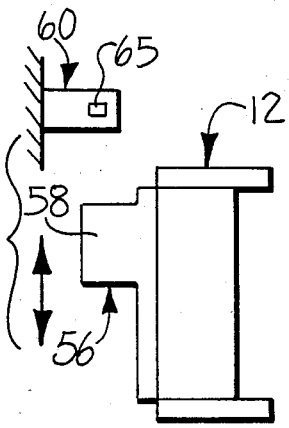

This is shown diagrammatically in FIGS. 16*a*–16*e* in each of which Figures are illustrated the same components of the printer as are illustrated in FIGS. 14*a*–14*i* FIG. 16*a* represents the position of the arm 12 in which the upper edge 59*a* of the tab 58 ceases to interrupt the beam of radiation to the sensitive device 65 as the arm moves downwards (point D in FIG. 15). FIG. 16*b* illustrates the arm 12 in its lowest (Home) position in which the direction of movement changes from down to up. FIG. 16*c* represents the position of the arm 12 in which the upper edge 59*a* starts to interrupt the beam of radiation to the device 65 as the arm moves upwards (point A in FIG. 15). Due to the finite width of the beam of radiation the positions of the arm 12 in FIGS. 16*a*, 16*c* are not the same, as indicated by the small distance d in FIG. 16*c*.

Figure 16D:
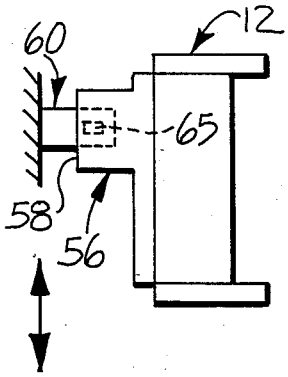

If the arm 12 is allowed to continue to move upwards from the position illustrated in FIG. 16*c* to the position illustrated in FIG. 16*d* and then reversed in direction until it reaches the position illustrated in FIG. 16*e* at which the edge 59*a* ceases to interrupt the beam to the device 65, the position of the arm 12 in FIG. 16*e* will be identical to the position of the arm in FIG. 16*a*.

By calculating the net number of stepper motor steps needed to move the arm 12 from the position in FIG. 16*a*, through the positions illustrated in FIGS. 16*b*, 16*c* and 16*d* and finally to the position illustrated in FIG. 16*e*, the number of stepper motor steps representing the movement between the positions in FIG. 16*a* and 16*e* is accurately determined and from this can be determined the rotational position of the stepper motor corresponding to the position of the arm in FIG. 16*b*, the Home Position of the arm. This calculation avoids any mechanical and optical tolerance of the components of the sensing device 60.

During subsequent operation of the printer the ribbon will be given a small amount of transverse movement by forward and reverse rotation of the stepper motor. If the ribbon is a multicolored ribbon this small amount of transverse movement will keep the selected colored stripe in the print region but will allow the full width of the stripe to be used for printing.

While the invention has been described as applied to a printer having print elements mounted on a moving metal band and a fixed bank of hammers it will be appreciated that the invention could equally be applied to a wire matrix printer having a print head with print wires moving along the platen or any other printing mechanism in which transverse movement of a ribbon or other medium is required.

What we claim is:

1. A printer comprising a frame, a platen mounted on said frame, a print mechanism for performing printing operation on a print medium, means for mounting said print mechanism on said frame adjacent to said platen so as to define a print region between said print mechanism and said platen, a removable ink ribbon cartridge containing an ink ribbon and including a body adapted to contain said ink ribbon, two spaced apart arms pivotally attached to said body and defining a gap therebetween and forming a support for said ink ribbon so that a portion of said ink ribbon extends across said gap, a first indicator mounted on one of said arms, means for removably mounting said cartridge body on said frame so that the gap between said arms is located adjacent to said print region and the portion of said ribbon extending across said gap is located within said print region, and ribbon feed apparatus for feeding said ribbon out of said cartridge body, along one of said arms, across said gap, along the other of said arms and back into said cartridge body, and a ribbon feed drive adapted to connect with said ribbon feed apparatus when said cartridge is in position on said frame so as to operate said ribbon feed apparatus, characterized by the improvement that said printer also comprises a cartridge arm moving mechanism including a drive system, means for removably coupling said drive system to the arms of a ribbon cartridge in position in said frame so that said arms can be pivoted independently of said cartridge body whereby said ink ribbon can be moved within said print region in the direction transverse to its length, and an indicator system including a sensing device, means for mounting said sensing device on said frame so that said sensing device senses the position of said first indicator when said cartridge is in position on said frame, and said one of said arms is in position coupled to said drive system, signal generating means in said sensing device for generating a signal corresponding to the sensed position of said first indicator and for interpreting said signal and for indicating the position of said arm and hence the transverse position of the portion of the ink ribbon within said pring region.

2. A printer as claimed in claim 1 characterized by the improvement that said signal interpreting means comprises means for detecting when said arm is in a reference position, and means for detecting the position of said arm at any instant relative to said reference position.

3. A printer as claimed in claim 1 characterized by the improvement that said signal generating means comprises means for detecting when said arm is in a reference position corresponding to the limit of movement of said arm in one direction, and means for detecting the position of said arm at any instant relative to said reference position.

4. A printer as claimed in claim 1 characterized by the improvement that said signal generating means indicates whether said cartridge is installed correctly in said printer.

5. A printer as claimed in claim 1 characterized by the improvement that said indicator system comprises a second indicator mounted on said arm at a predetermined distance from said first indicator which distance is dependent upon the type of ribbon in the cartridge, and that said sensing device sense the position of said second indicator when said cartridge is mounted on said frame, and that said signal generating means generates a further signal corresponding to the sensed position of said second indicator and hence the type of ribbon in the cartridge.

* * * * *

UNITED STATES PATENT AND TRADEMARK OFFICE

CERTIFICATE OF CORRECTION

PATENT NO. : 4,586,837

DATED : May 6, 1986

INVENTOR(S) : Johnson et al.

It is certified that error appears in the above-identified patent and that said Letters Patent is hereby corrected as shown below:

Column 12, line 58, "pring" should be -- print --.

Column 14, line 5, "sense" should be -- senses --.

Signed and Sealed this

Twenty-first Day of October, 1986

[SEAL]

*Attest:*

DONALD J. QUIGG

*Attesting Officer*

*Commissioner of Patents and Trademarks*